US006121564A

United States Patent [19]

Huang

[11] Patent Number: 6,121,564

[45] Date of Patent: Sep. 19, 2000

[54] KEYSWITCH STRUCTURE

[75] Inventor: Gear Huang, Taipei, Taiwan

[73] Assignee: Silitek Corporation, Taipei, Taiwan

[21] Appl. No.: 09/299,915

[22] Filed: Apr. 28, 1999

[51] Int. Cl.[7] ..... H01H 13/70; H01H 3/12

[52] U.S. Cl. ..... 200/345

[58] Field of Search ..... 200/5 A, 512, 200/517, 341, 342, 344, 345; 400/490–495

[56] References Cited

U.S. PATENT DOCUMENTS

| | | | |
|---|---|---|---|
| 4,939,324 | 7/1990 | English et al. | 200/345 |
| 5,283,408 | 2/1994 | Chen | 200/345 |
| 5,710,397 | 1/1998 | Liao | 200/345 X |
| 5,794,762 | 8/1998 | Tsai | 200/345 |
| 5,938,009 | 8/1999 | Huang | 200/345 X |

*Primary Examiner*—J. R. Scott
*Attorney, Agent, or Firm*—Rosenberg, Klein & Lee

[57] ABSTRACT

The present invention provides an improved keyswitch structure to overcome the shaking and friction problem in the conventional keyswitch. The improved keyswitch structure is characterized in that at least one guiding slit is formed on the outer wall of the frame, at least one guiding body is formed on the inner wall of the guiding groove and corresponding to the guiding slit; and two slim flanges are provided on each corner of the outer wall of the frame whereby the slim flanges are in contact with the four corners of the inner wall of the guiding stage and can move upward and downward smoothly.

7 Claims, 3 Drawing Sheets

KEYSWITCH STRUCTURE

FIELD OF THE INVENTION

The present invention relates to an improved keyswitch structure, wherein the key cap will not shake during key operation, and the contact area between the guiding pole and the guiding stage is reduced.

BACKGROUND OF THE INVENTION

FIG. 1 shows a conventional keyswitch structure, which comprises a key cap 10*a,* a guiding stage 11*a* and a rubber cone 12*a*. The cap 10*a* is a rectangular-shaped cover and has a rectangular frame 13*a,* which has four quarter-circle poles 14*a* on the four corners thereof. The guiding stage 11*a* is arranged on the keyboard panel 15*a* and has a rectangular guiding groove, or, 16*a* on top side thereof such that the four poles 14*a* are sildably fitted within the guiding groove 16*a*. The rubber cone 12*a* is received within the guiding groove 16*a* and is made of conductive rubber.

When the user presses down the cap 10*a,* the frame 13*a* is forced to move downward along the guiding groove 16*a*. At this time, the rubber cone 12*a* is collapsed such that the conductive edge (not shown) is in contact with the circuit under the panel 15*a*. A pulse signal is generated to response the pressing operation.

However, in the above-mentioned keyswitch, the cap 10*a* is supported by fitting the frame 13*a* thereof along the guiding groove 16*a* of the guiding stage 11*a*. The cap 10 a is unstable during operation. Moreover, the quarter-circle poles 14*a* of the frame 13*a* are in contact with the four inner corners of the guiding groove 16*a*. The contact area is relatively large such that the smooth movement of cap 10*a* may be hindered. Moreover, the upper end of the inner wall of the guiding groove 16*a* is square in profile such that the insertion of the frame 13*a* into the guiding groove 16*a* is difficult.

In one aspect of the invention, at least one guiding slot is arranged on the outer wall of the frame, and at least one guiding strip is arranged on the inner wall of the guiding groove to guide the movement of the frame and enhance stable displacement of the cap. Moreover, two slim flanges are provided on each corner of the frame to reduce the friction.

In another aspect of the invention, arc-shaped guiding surface, or taper, is provided on the upper inner wall of the guiding groove to guide the fame into the guiding groove.

The various objects and advantages of the present invention will be more readily understood from the following detailed description when read in conjunction with the appended drawing, in which:

DETAILED DESCRIPTION OF THE PREFERRED EMBODIMENTS

Figure 1:
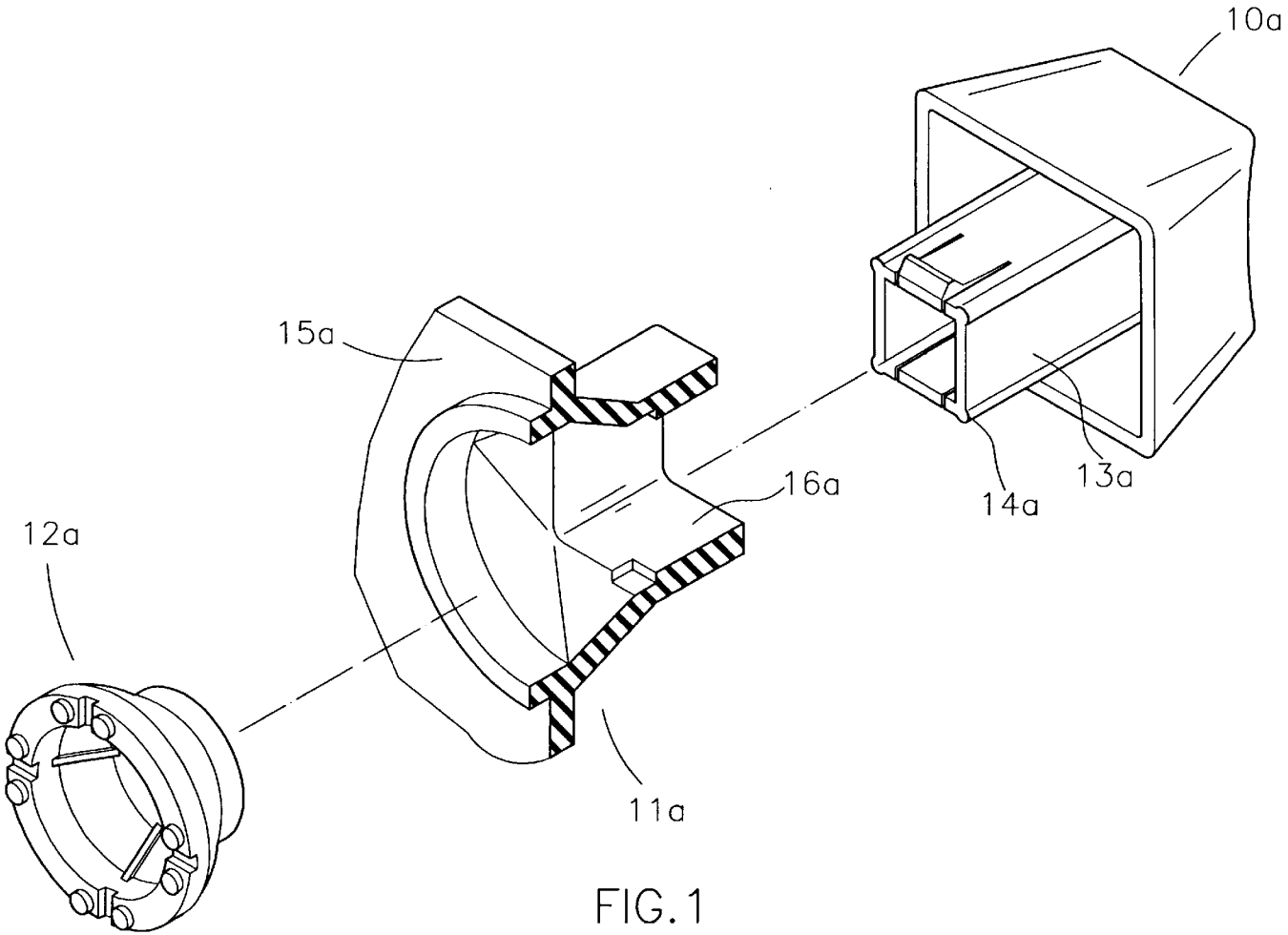
FIG. 1 PRIOR ART
FIG. 1 is the exploded view of the prior art.
Figure 2:
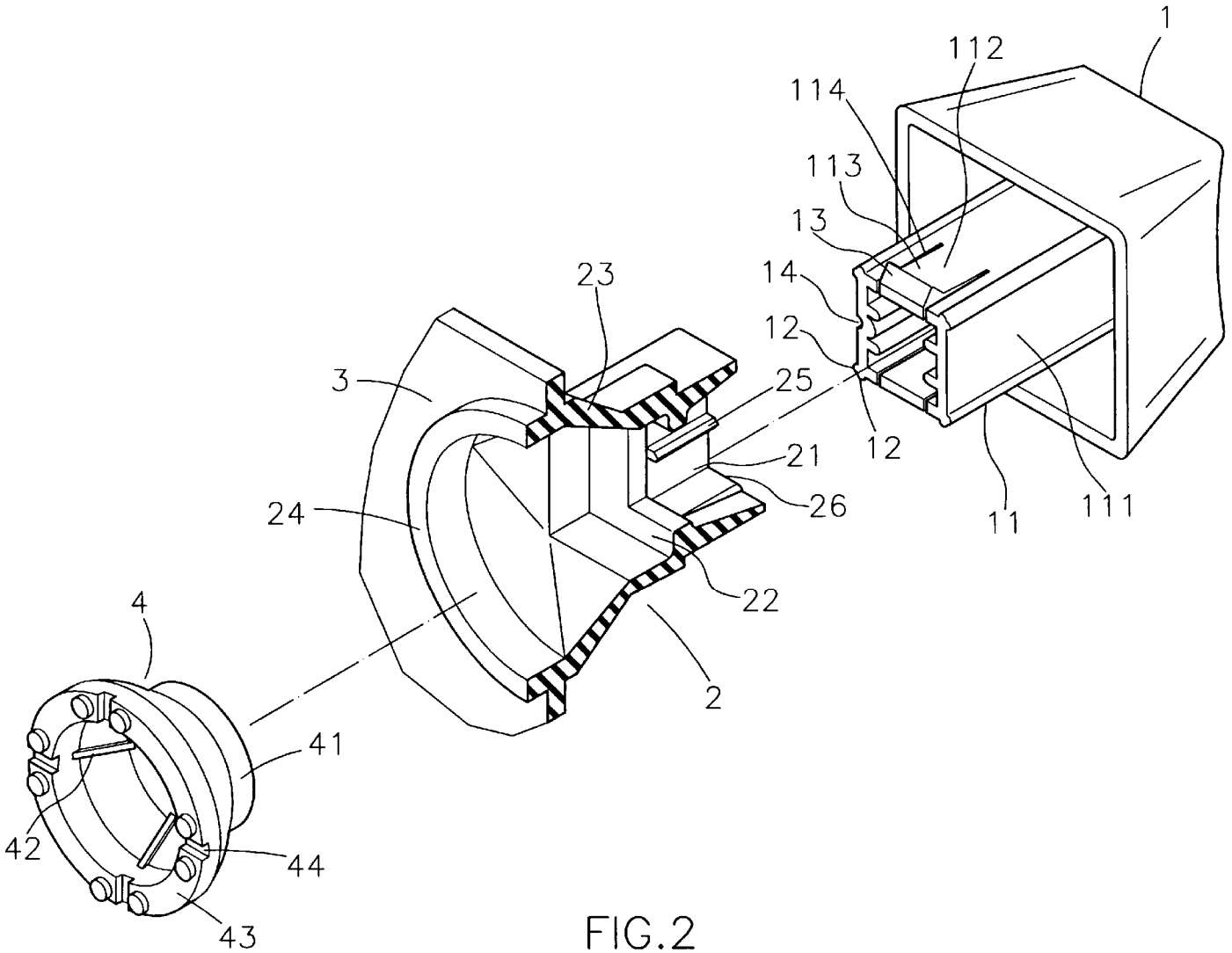
FIG. 2 is the exploded view of the present invention.
Figure 4:
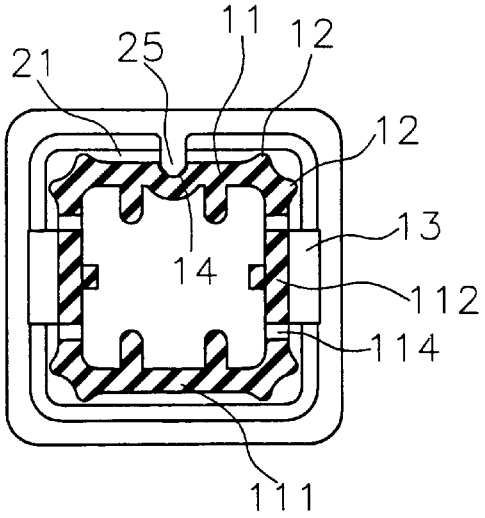
FIG. 4 is the top view of the invention.
Figure 3:
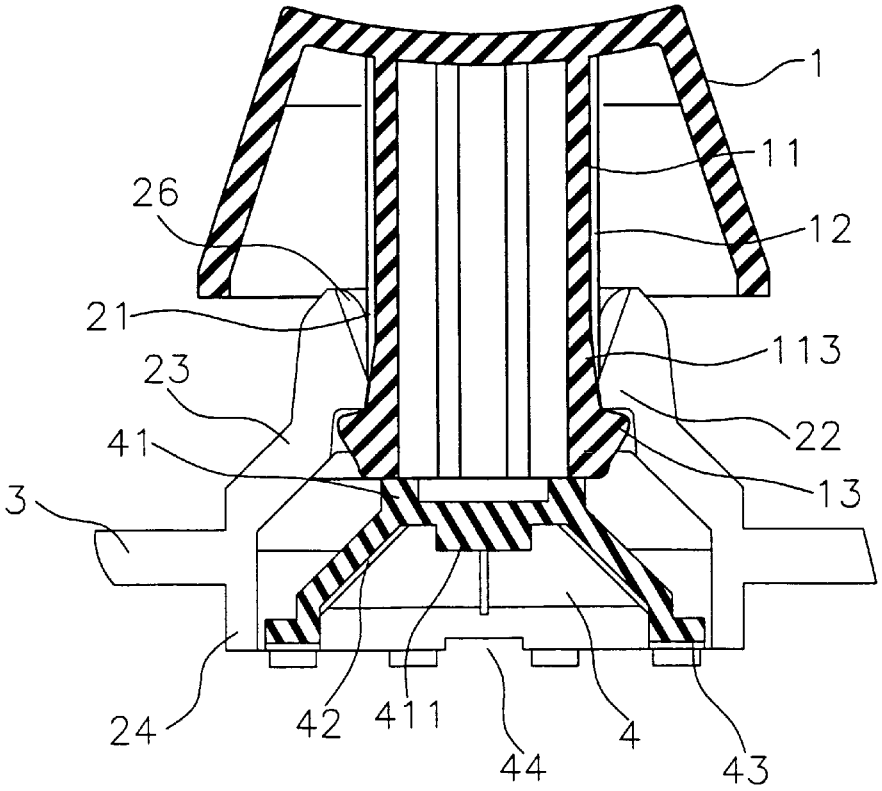
FIG. 3 is the cross section view of the invention.

As shown in FIGS. 2 to 4, the improved keyswitch structure according to the present invention comprises a key cap 1, a guiding stage 2 and a rubber cone 4. The cap 1 is a rectangular-shaped cover and has a rectangular frame 1, wherein two arc-shaped slim flanges 12 are provided on each corner thereto, two opposed surfaces of the frame 1 form fixing surfaces 111, and two of the fixing surfaces of the frame 11 each has gaps 114 with that forms flexible plates 112. The flexible plate 112 has an extruded arc-shaped surface 113 and hook 13 on end portion thereof. At least one guiding slot 14 is provided on the outer wall of the frame 11.

The guiding stage 2 is arranged on the keyboard panel 3 and has a rectangular guiding groove, or space, 21 on top side thereof such that the flanges 12 are slidably fitted within the guiding groove 21 of the guiding stage 2. In other word, the frame 11 is received within the guiding groove 21 of the guiding stage 2. Moreover, the guiding stage 2 has a stop portion 22 on an inner side thereof that is engaged with the hook 13 of the flexible plate 112. An arc-shaped guiding surface, or taper, 26 is provided on the upper end of the guiding groove 21. At least one guiding body 25 is provided within the guiding slot 14 to guide the cap 1 to move upward and downward smoothly. The end of the guiding body 25 is of triangular shape such that the guiding body 25 can be in three-point contact with the guiding slot 14 to reduce the contact area. Moreover, a bell-shaped opening 23 is formed below the guiding groove 21 which has a ring body below.

The rubber cone 4 is received within the bell-shaped opening 23 and is made of conductive rubber. The rubber cone 4 is of hat-shape and has a top cover 41 attaching to the surface of the frame 11. The rubber cone 4 has a conductive cotton 411 therein and reinforcing rib 42 on inner wall thereof, and has venting hole 44 on the edge 43.

The above-mentioned elements are assembled to from a keyswitch and the features thereof are stated below.

When the user presses down the cap 1, the frame 11 is forced to move downward along the guiding groove 21. At this time, the rubber cone 12*a* is collapsed because the top cover 41 of the rubber cone 4 is attached to the surface of the frame 41. The air within the rubber cone 4 can be rapidly exhausted through the venting hole 44 and the conductive cotton 411 in the rubber cone 4 is in contact with the circuit under the panel 3. A pulse signal is generated responsive to the pressing operation.

The present invention has following advantages:

1. The outer wall of the frame 11 has a guiding slot 14 to match with the guiding body 25 on the inner wall of the guiding groove 21 such that the frame 11 can move upward and downward smoothly, and the cap has no stability problem during operation.

2. The outer wall of the frame 11 has a plurality of slim flanges 12, which are in contact with the inner wall of the guiding groove 21. The flanges 12 have slim shape to reduce the contact area with the guiding stage 2 such that the frame 11 can move upward and downward smoothly, and the cap has no stability problem during operation.

3. The upper inner end of the guiding groove 21 of the guiding stage 2 has arc-shaped guiding surface 26 such that the frame 11 can be smoothly inserted into the guiding groove 21.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A keyswitch assembly for actuating a switch of a keyboard panel comprising:

(a) a guiding stage coupled to the keyboard panel, said guiding stage having a guiding portion extending longitudinally from a stop portion, said guiding portion having an inner surface defining a longitudinally directed guiding space, said stop portion extending transversely into said guiding space, said guiding portion having formed on said inner surface thereof a longitudinally extended guiding body protruding into said guiding space;

(b) a key cap displaceably coupled to said guiding stage, said key cap having a main body portion and a frame portion extending longitudinally therefrom, said frame portion engaging said guiding space, said frame portion having a substantially rectangular sectional contour defined by a plurality of fixing surfaces, at least a pair of said fixing surfaces each having a flexible plate section resiliently formed therein, said flexible plate section having a terminal end and an arcuate protrusion formed adjacent said terminal end, at least one of said fixing surfaces having formed therein a longitudinally extended guiding slot slidably engaging said guiding body of said guiding stage, said frame portion including a plurality of longitudinally extended flange segments respectively disposed between adjacent pairs of said fixing surfaces for slidably engaging said inner surface of said guiding portion; and, (c) an elastic cone received within said guiding stage and operably coupled to said key cap frame portion for selectively actuating the keyboard panel switch responsive to displacement of said key cap.

2. The keyswitch assembly as recited in claim 1 wherein each said flange segment includes a pair of longitudinally extended arcuate protrusions.

3. The keyswitch assembly as recited in claim 1 wherein said guiding portion includes an open end, said guiding portion having a tapered edge adjacent said open end.

4. The keyswitch assembly as recited in claim 1 wherein said guiding stage includes a bottom portion coupled to said stop portion, said bottom portion having a flared section extending radially and longitudinally outward from said stop portion to a ring body section.

5. The keyswitch assembly as recited in claim 1 wherein said elastic cone includes an edge portion and an inner wall portion extending therefrom, said elastic cone having formed on said inner wall portion at least one reinforcing rib and in said edge portion at least one venting hole.

6. The keyswitch assembly as recited in claim 5 wherein said elastic cone is formed of a composition containing a rubber material and a conductive cotton material.

7. The keyswitch assembly as recited in claim 1 wherein said guiding body of said guiding stage includes a longitudinally extended free end having a substantially triangular sectional contour for three point engagement of said guiding slot.

* * * * *